United States Patent [19]

Klomser et al.

[11] 4,108,145

[45] Aug. 22, 1978

[54] FIREPLACE CLOSURE

[76] Inventors: Jean M. Klomser; Jeffrey L. Klomser, both of Rte. 7, Box 128, Chapel Hill, N.C. 27514

[21] Appl. No.: 793,632

[22] Filed: May 4, 1977

[51] Int. Cl.[2] ..... F24C 15/10

[52] U.S. Cl. ..... 126/140; 126/202; 160/DIG. 9

[58] Field of Search ..... 126/202, 138, 140; 160/DIG. 9

[56] References Cited

U.S. PATENT DOCUMENTS

| | | | |
|---|---|---|---|
| 2,398,240 | 4/1946 | Merryweather et al. | 126/140 |
| 3,789,825 | 2/1974 | Reiner | 126/140 |

*Primary Examiner*—Edgar W. Geoghegan
*Attorney, Agent, or Firm*—Mills & Coats

[57] ABSTRACT

In abstract a preferred embodiment of the present invention is an adjustable fireplace closure which when properly installed closes the front opening about a fireplace and virtually eliminates the drafting action of the fireplace.

10 Claims, 4 Drawing Figures

FIREPLACE CLOSURE

The present invention relates to fireplaces and more particularly to an adjustable fireplace closure which is adapted to be utilized about fireplace openings of various cross sectional areas.

BACKGROUND OF THE INVENTION

In the past, fireplaces were as commonly included in the construction of a home as were doors and windows. Furthermore, these fireplaces were used year-round for cooking as well as for heating.

Generally, fireplaces of the past were large in volume with stone hearths and chimneys that formed a substantial part of the wall about which it was disposed. This large scale was necessary in order to heat large rooms or even entire homes.

The advent of wood stoves in later years tended to alleviate the necessity of having such a large fireplace. In addition, as newer and more efficient heating systems were developed, many homes were constructed without even including a fireplace. But for many individuals, fireplaces remain very desirable as they are functional and create a pleasing atmosphere within a room. For such reasons fireplaces are still found today in many homes.

In recent years an energy crisis has developed with the result being higher heating fuel prices due to a shortage of all types of energy. It follows that industry must develop energy saving devices which are both practical and economically obtainable for the public. Furthermore, the homeowner must adapt every conservation measure at his disposal. For example, the homeowner should insulate his house and seal any and all air leaks which may exist around doors and windows. In this respect it can be appreciated that an additional area that needs particular attention is the fireplace.

Anyone familiar with how a fireplace functions appreciates the fact that air is drawn from a room and expelled by the chimney associated with the fireplace. One can also appreciate that when not in use, a fireplace continually tends to draft away a room's heated air. Thus, at times when there is not a fire in the fireplace, the efficiency of the room's heating system is adversely affected.

To help solve this problem of heat loss in the winter and even air conditioned air loss in the summer, dampers have been developed. The damper is placed between the fireplace proper and the chimney. Basically the damper is adapted to close off the fireplace from the chimney. This in fact eliminates the drafting action of the fireplace, but the fire has to be entirely out before the damper can be closed, otherwise the room would fill with smoke. The disadvantage of this is obvious. For instance, if during the evening hours a fire is built within the fireplace, the damper has to be left open at bedtime. Subsequently during the early hours of the morning when the fire has long since died out, the fireplace is still drawing heated room air out. Along this line, it should be pointed out that many older homes have fireplaces which were built without incorporating a damper.

SUMMARY OF THE INVENTION

After much study and observation the fireplace closure of the present invention has been developed to be attached to a fireplace to virtually eliminate energy loss due to a fireplace's drafting action. In addition the fireplace closure of the present invention may be installed to eliminate drafting of room air when a fire is substantially out, such as at bedtime.

Basically the fireplace closure of the present invention comprises a central closure panel having a laterally adjustable side panel generally disposed on each side thereof. Thus, fireplace openings of various sizes can be accommodated by centering the central panel about the fireplace opening and sliding each side panel laterally to where the entire fireplace opening is closed. A retaining mechanism is operatively connected between the fireplace closure and the fireplace structure for properly retaining the fireplace closure about the fireplace opening.

It is therefore an object of the present invention to present a fireplace closure, which when installed closes a fireplace opening and prevents room air from entering the fireplace.

Another object of the present invention is to provide a fireplace closure which may be removably attached to a fireplace.

A further object of the present invention is to provide a fireplace closure which may be adapted to fireplaces having openings of differing cross sectional areas.

An even further object of the present invention is to present a fireplace closure which may be removably attached to fireplaces having various types of screening devices.

Another object of the present invention is to present a fireplace closure which incorporates an impervious center section having two oppositely disposed impervious side sections which are slidably attached thereto, for covering fireplace openings of various widths.

Another object of the present invention is to provide a fireplace closure having a decorative facies which presents a pleasing appearance when viewed in the installed mode.

Yet another object of the present invention is to provide a fireplace closure which is supported by a hearth and held firmly against a mantel by an attaching means associated with the fireplace closure.

In addition another object of the present invention is to present a fireplace closure which conceals the unsightly interior of a soot blackened fireplace.

Other objects and advantages of the present invention will become apparent from a study of the following description and the accompanying drawings which are merely illustrative of the present invention.

DESCRIPTION OF THE PREFERRED EMBODIMENT

Figure 1:
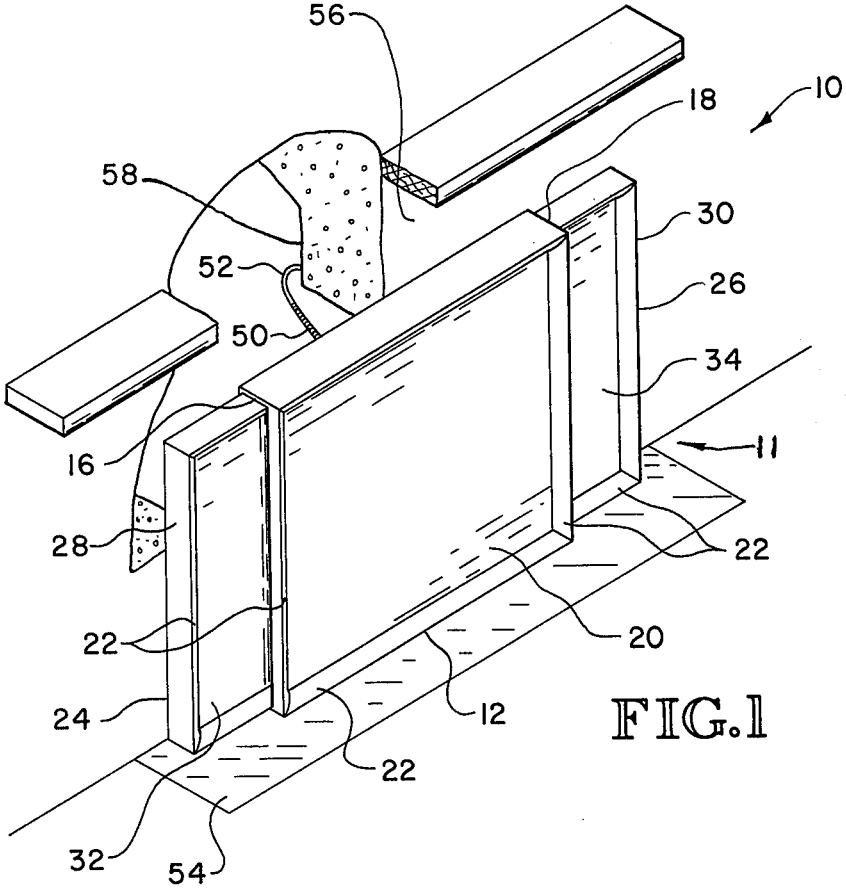
FIG. 1 is a perspective view of the fireplace closure of the present invention installed about a fireplace with a portion of the fireplace being removed to better insulate the attaching means associated with the fireplace closure.

With further reference to the drawings particularly FIG. 1 a fireplace closure is shown therein and indicated generally by the numeral 10. Fireplace closure 10 is generally constructed of metal or other suitable fire resistant materials.

Fireplace closure 10 is comprised of a center section 12 which is installed upright about the center of a fireplace indicated generally by the numeral 11. Extending laterally from opposite sides of center section 12 are side sections 24 and 26 which incorporate an adjustable capability for completely closing a fireplace opening. In addition, fireplace closure 10 includes attaching means 13 (FIG. 3) which is secured to the back side of center section 12. As will be pointed out subsequently in more detail, attaching means 13 is generally elastic in nature and acts to retain the fireplace closure 10 about the opening of fireplace 11.

Center section or panel 12 comprises a flat rectangular box type structure having a front impervious surface 20. Frontal surface 20 has integrally disposed about its periphery an ornamental type molding 22.

Figure 3:
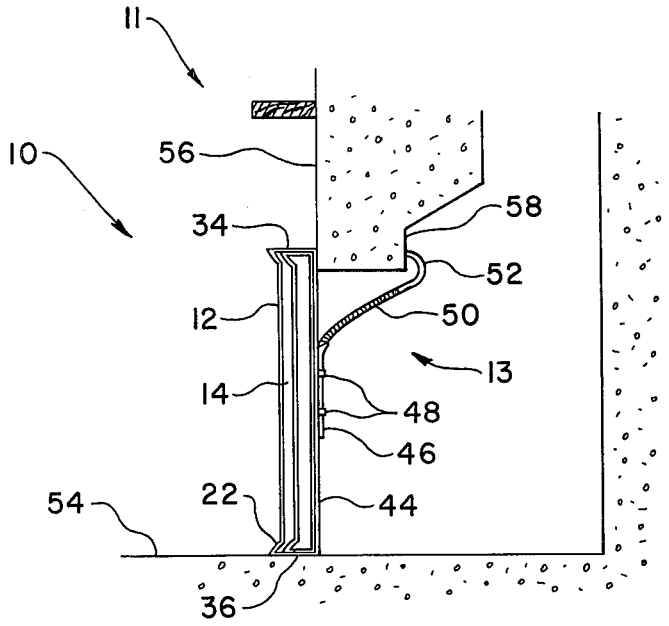
FIG. 3 is a cross sectional view of a fireplace showing the fireplace closure installed.

Referring to FIG. 3 it is illustrated that center section 12 has an interior opening 14 which is communicatively connected to the outside of center section 12 by oppositely disposed openings 16 and 18.

Figure 2:
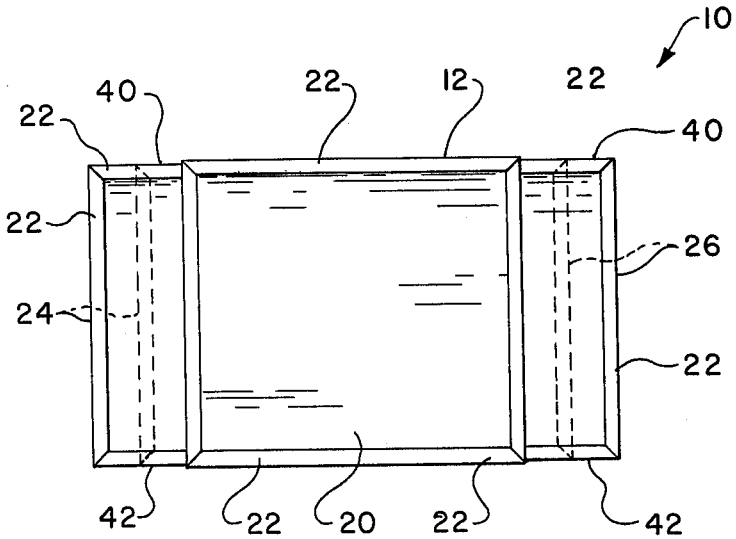
FIG. 2 is a front elevational view of the fireplace closure of the present invention illustrating the adjusting capability of the slidably attached side sections.

Inserted within openings 16 and 18 of center section 12 are slidably extendible rectangular side sections 24 and 26. FIG. 2 illustrates the opposite multi-positioning capability of side sections 24 and 26. Side sections 24 and 26 are preferably of such a size that when both are fully inserted into center section 12, their outermost sides 28 and 30 are flush with the adjacent sides of center section 12. Side sections 24 and 26 have integrally disposed about the periphery of their frontal surfaces 32 and 34 an ornamental type molding 22 such as that used on center section 12.

Figure 4:
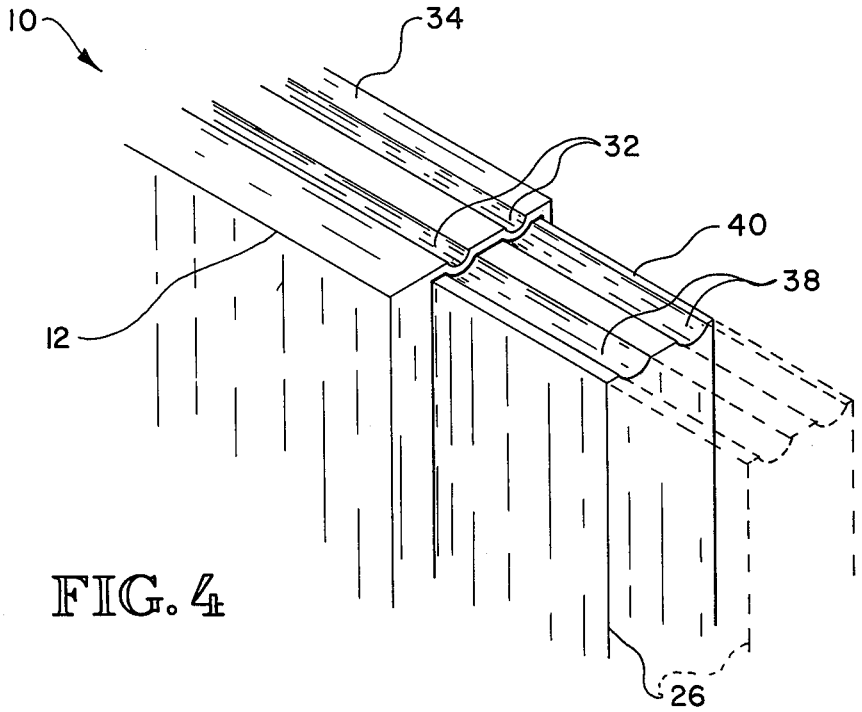
FIG. 4 is a fragmentary perspective view of the present invention illustrating an alternate method of slidably attaching the side sections to the center section.

FIG. 4 illustrates an alternate design for stabilizing respective side sections in the center section 12 of fireplace closure 10. This alternative method incorporates a basic groove and runner type configuration. As shown in FIG. 4 the runners 32 protrude into interior opening 14 of center section 12 from both top 34 and bottom 36 sides of the same. Grooves 38 are formed into top 40 and bottom 42 of side sections 24 and 26. When side sections 24 and 26 are aligned for insertion into center section 12 the runners and grooves mesh to provide a stabilizing effect. Therefore, side sections 24 and 26 may be laterally extended to their limitation without the stability of the same being adversely affected.

Referring to FIG. 3, a cross section of fireplace closure 10 is shown installed about the opening of fireplace 11. As illustrated therein, spring retaining tube 46 of attaching means 13 is secured vertically about the midportion of back side 44 of center section 12 by bands 48. Attached thereto and extending upward from the upper portion of spring retaining tube 46 is a spring 50. Fixedly attached to the other end of spring 50 is an attaching hook 52 that is adapted to grapple a portion of the fireplace structure.

In actual application fireplace closure 10 is placed upright on hearth 54 and adjacent mantel 56. Side sections 24 and 26 are then moved inwardly into center section 12. The center section 12 is centered in front of the fireplace opening and attaching hook 52 is hooked to interior upper wall 58 of fireplace 11 thereby placing spring 50 in tension. Side sections 24 and 26 are then extended to cover any remaining fireplace opening. The tension of spring 50 tends to bind the fireplace closure 10 snugly against the mantel 56.

It is quite obvious to anyone skilled in the art that the present invention can be easily adapted to and installed on a variety of fireplaces having differing opening dimensions. It can also be appreciated that the present invention is simple in construction, economical in cost and ornamental in design. Furthermore, the present invention presents an energy saving device by eliminating the drafting of a fireplace when the fireplace is not in use.

The terms "front", "back", "upper", "bottom", etc., have been used herein merely for the convenience of the foregoing specification and in the appended claims to describe the fireplace closure and its parts as oriented in the drawings. It is to be understood, however, that these terms are in no way limiting to the invention since the fireplace closure may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced herein.

What is claimed is:

1. An adjustable fireplace closure adapted to close various size fireplace openings, said adjustable fireplace closure comprising: a central closure section including an impervious face panel and having an open area formed therein; first and second adjustable side sections operatively associated with said central closure section with each side section including an impervious face panel and movably mounted in the open area of said central closure section and movable from an inner retracted position to an outer extended position with respect to said central closure section, whereby the effective width of said fireplace closure may be adjusted by moving said first and second side sections between said inner and outer positions; and retaining means secured to said fireplace closure and extending therefrom and including means for attachment to a fireplace structure, such that said fireplace closure may be firmly retained adjacent a fireplace opening by attaching said retaining means to a portion of the adjacent fireplace structure.

2. The fireplace closure of claim 1 wherein said retaining means includes: a spring, and means for anchoring one end of said spring to a back side of said central closure section; and wherein said means of said retaining means for attaching said retaining means to said fireplace structure includes a hook secured to an end of said spring opposite the end anchored to the back of said central closure section.

3. The fireplace closure of claim 2 wherein said means for anchoring said spring to said central closure section includes a tubular member connected to said spring and wherein said tubular member is secured to the back of said central closure panel by strap means secured to the back side of said central closure panel and which extend generally around a portion of said tubular member.

4. The fireplace closure of claim 3 wherein said central closure section and said first and second side sections all include an outer molding about the face portions of each.

5. The fireplace closure of claim 1 wherein said central closure section and said first and second sections are constructed with a cooperative groove and runner design about top and bottom areas thereof, such that said first and second sections are maintained in a generally stable posture relative to said central closure section.

6. The fireplace closure of claim 4 wherein said central closure section is of a metal box design and wherein the back thereof is spaced rearwardly of said impervious face panel.

7. The fireplace closure of claim 1 wherein said retaining means includes an elastic member secured to said central closure section and extending therefrom where said means for attachment thereof is connected to a remote end of said elastic member and adapted to be attached to said fireplace structure.

8. An adjustable fireplace closure adapted to close various size fireplace openings, comprising: a first closure section including an impervious face panel and having an open area formed therein; at least one inner closure section operatively associated with said first closure section and including an impervious face panel and movably mounted in the open area of said first closure section and movable from a retracted position to an extended position with respect to said first closure section, whereby the effective width of said fireplace closure may be adjusted by moving said inner closure section between said retracted and extended positions; and retaining means secured to said fireplace closure and extending therefrom and including means for attachment to an adjacently disposed fireplace structure, such that said fireplace closure may be firmly retained adjacent a fireplace opening by attaching said retaining means to a portion of the adjacent fireplace structure.

9. The fireplace closure of claim 8 wherein said retaining means includes an elastic member, anchor means secured to one end of said elastic member and attached to a back portion of said first closure section; and wherein said means of said retaining means for attachment to said fireplace structure includes a hook secured to the end of said elastic member opposite the end anchored to said first closure section.

10. The fireplace closure of claim 9 wherein said elastic member includes a spring.

* * * * *